United States Patent [19]

Tonomoto

[11] Patent Number: 4,984,028

[45] Date of Patent: Jan. 8, 1991

[54] CLEANING UNIT FOR CLEANING RECORDING MEDIUM OF AN ELECTROPHOTOGRAPHIC APPARATUS

[75] Inventor: Yoshihiro Tonomoto, Yokohama, Japan

[73] Assignee: Fujitsu Limited, Kawasaki, Japan

[21] Appl. No.: 284,101

[22] Filed: Dec. 14, 1988

[30] Foreign Application Priority Data

Dec. 18, 1987 [JP] Japan ..... 62-318637

[51] Int. Cl.[5] ..... G03G 21/00

[52] U.S. Cl. ..... 355/297; 355/298

[58] Field of Search ..... 355/296, 297, 298, 304, 355/215; 118/652

[56] References Cited

U.S. PATENT DOCUMENTS

| | | | |
|---|---|---|---|
| 3,278,972 | 10/1966 | Hudson | 355/302 X |
| 4,361,922 | 12/1982 | Karal | 118/652 X |
| 4,364,660 | 12/1982 | Oda | 355/297 |
| 4,390,268 | 6/1983 | Furuichi et al. | 355/297 |
| 4,411,042 | 10/1983 | Sakata et al. | 118/652 |
| 4,451,139 | 5/1984 | Yanagawa et al. | 355/297 |
| 4,601,569 | 7/1986 | Garris | 355/298 X |
| 4,806,981 | 2/1989 | Ishiguro et al. | 355/298 |

*Primary Examiner*—Fred L. Braun

*Attorney, Agent, or Firm*—Staas & Halsey

[57] ABSTRACT

A toner image transfer type recording apparatus having a cleaning unit for removing residual contaminants from the surface of a rotating recording drum after toner image transfer. The cleaning unit includes a blade which engages the surface of the drum, a rotatable cleaning cylinder disposed immediately upstream from the blade, and a housing structure surrounding the blade and the rotatable brush. The housing is evacuated by an air pump connected thereto, causing external air to be introduced through an opening of the housing to facilitate removal of the contaminants from the housing.

11 Claims, 5 Drawing Sheets

CLEANING UNIT FOR CLEANING RECORDING MEDIUM OF AN ELECTROPHOTOGRAPHIC APPARATUS

BACKGROUND OF THE INVENTION

1. Field of the Invention

The present invention relates to a recording apparatus of the toner image transfer type, namely electrostatographic apparatus, such as an electrophotographic apparatus or an electrostatic electrographic apparatus. In particular, it relates to an improved cleaning device to remove residual contaminants from the surface of the recording medium of the recording apparatus after a toner image transfer operation.

2. Description of the Related Art

As is well known, in a recording apparatus of the toner image transfer type, such as an electrophotographic printer or copying machine, or an electrographic printing machine or copying machine, an electrostatic latent image is formed on a recording medium such as a photoconductive drum or dielectric drum. The latent image is developed as a toner image formed on the surface of the drum. Thereafter, the toner image is adhesively transferred onto a printing medium such as cut sheet or web at an image transfer station of the apparatus where the surface of the recording medium and that of the printing medium are set in contact with each other. The present invention is applicable to both electrophotographic recording apparatus and electrographic recording apparatus. However, for clarity and simplicity of description, the description of the present invention will be limited to an electrophotographic recording apparatus having a photoconductive drum and employing cut sheet as a printing medium.

Since the image transfer usually does not remove all the toner particles from the surface of the recording medium but leaves a small amount of toner particles thereon, and since it is necessary to keep the surface of the recording medium clean for subsequent image formation thereon, the surface must be cleaned completely immediately after the image transfer. Accordingly, at the next cleaning station, contaminants remaining on the surface of the photoconductive drum, including residual toner particles, toner carriers, and paper lints, are removed. A cleaning device, therefore, is disposed downstream from the image transfer station with respect to the rotation of the drum. Hereinafter, the terms "downstream" and "upstream" are used with respect to the rotating movement of the photoconductive drum.

There have been two types of conventional cleaning devices. One is a type having a rotatable cleaning means such as a rotatable brush including a number of bristles made of plastic wire, mounted around a rotatable shaft, or a rotatable cylinder of sponge-like material formed around a shaft. The cleaning means extends in the axial direction of the photoconductive drum. The other is a blade type using a blade of elastic material such as polyurethane rubber. The blade extends in the axial direction of the photoconductive drum, and is disposed such that the edge of the blade engages with the rotating surface of the photoconductive drum in pressure contact therewith. The cleaning capability of a cleaning device of the rotatable type is not sufficient since there is a tendency to cause a contaminated toner image on a cut sheet or to cause fluctuated electric discharge of the electric discharger due to the residual toner particles scattered by brushing.

A cleaning device of the blade type normally can clean the surface of the photoconductive drum satisfactorily. However, there is a problem of abrasion of the edge of the blade caused by contaminants of large size such as toner carriers and paper lints accumulated on the edge as described hereafter.

When the feed passage of the cut sheet is selectively disposed in an upper portion of the recording apparatus, the image transfer station must be set at the top portion of the photoconductive drum. This configuration of the arrangement of the photoconductive drum to the printing medium is essentially beneficial for an operator of the apparatus, because removal of jammed sheets and replacement of the photoconductive drum, can be performed very easily and safely from the top side of the apparatus without damaging the surface of the photoconductive drum. The sheet jamming tends to occur at a portion of the sheet feed passage located in the vicinity of the image transfer station. Consequently, approach to the jammed cut sheet and the photoconductive drum by the operator, can be done easily only by opening the upper portion of the recording apparatus.

With respect to the above-described configuration of the arrangement of the photoconductive drum and the feed passage for the cut sheet, the blade must be naturally disposed such that the edge of the blade engages along a substantially downwardly moving surface of the photoconductive drum in pressure contact therewith and the edge of the blade is directly upstream, usually upwardly. When the edge scrapes the surface of the photoconductive drum to remove the contaminants thereon, the scraped contaminants might accumulate on the edge of the blade. The accumulated contaminants contain toner particles, toner carriers and paper lints. The toner particles are fine particles having a diameter of micron order. The toner carriers contained in two-component developer material have diameters of ten micron order. When two-component developer material is employed, the toner carrier tends to be scattered inside the apparatus by the centrifugal force of a rotating magnetic brush which is formed of the developer material. The paper lints have a larger size, range from 50 to 100 microns, and are generated by friction between the advancing printing medium and the sheet feed passages, particularly between the side edge of the printing medium and the passages.

The accumulated contaminants tend to stick to the edge of the blade, forming a layer stuck to a leading surface portion of the blade which is directly in contact with the surface of the photoconductive drum. As a result, the surface of the photoconductive drum is scratched and damaged by the toner carriers and the paper lints after some duration of recording operation. To avoid this damage, the used blades must be replaced with new ones, thus increasing the operating expense.

In addition, friction between an abraded blade edge and the surface of the photoconductive drum causes heat by which toner particles are melted. The melted toner particles make a thin film of toner particles stuck to the surface of the drum, disabling the portion of the surface covered by the film, This phenomenon is referred to in the art as "filming".

In contrast, fine toner particles appear to have a lubricant function. Thus, a layer of toner particles having a thickness is allowed to accumulate on the edge of the blade. However, particularly in a case where the top surface of the blade is formed to be perpendicular to the surface of the drum, forming a step there, toner particles accumulate on the step excessively, forming a pile on the top surface of the blade and the portion of the surface of the drum adjacent to the cleaning edge. This is not desirable because such piled toner particles tend to scatter within the recording apparatus, causing various problems. Further, some toner particles may pass underneath the cleaning edge, leaving a film on the peripheral surface of the drum. The film of toner particles may produce an unclear toner image formation.

As one of the countermeasures to solve the above-described problem in prior art recording apparatus, the edge of the blade is sharpened to be formed in a wedge-like shape, providing the blade with a slanted top surface over which scraped toner particles can easily fall down and the accumulation of the contaminants on the edge is reduced. However, the sharpening of the edge is rather difficult and costly, and the edge tends to be easily abraded by repeated recording operations.

SUMMARY OF THE INVENTION

It is an object of the present invention to provide a recording apparatus of the toner image transfer type capable of transferring clear images from a drum of recording medium onto a cut sheet.

Another object of the present invention is to provide a recording apparatus of the toner image transfer type having an image transfer station on the top side of a drum of recording medium with a suitable cleaning unit.

Still another object of the present invention is to provide an improved cleaning device having a cleaning blade for cleaning the surface of the drum of recording medium, wherein the blade is substantially protected from abrasion due to contaminants accumulated thereon and does not cause filming of the drum.

The above-described recording medium, hereinafter, is directed to a photoconductive material. The objects can be realized by an electrophotographic recording apparatus having a cleaning unit according to the present invention. In the apparatus, a cut sheet is advanced substantially horizontally, contacting with a photoconductive drum at an image transfer station located at the top portion of the photoconductive drum. The cleaning unit has a cleaning blade, a rotatable brush and a suction means working in cooperation therewith.

The cleaning blade is disposed such that the edge thereof can engage with the downwardly moving surface of the photoconductive drum at a portion downstream from the image transfer station, and is directed upwardly. Such a blade is referred to as a blade of the counter type. The rotatable fur brush having elastic hairs is disposed immediately upstream from the cleaning blade forming a mutual contacting zone on the surface of the drum. The rotatable brush is disposed such that it does not contact the edge of the blade, leaving a narrow non-contact portion between the edge of the blade and the contacting zone.

Contaminants of relatively large size such as paper lints and toner carriers, if any, remaining on a portion of the surface of the photoconductive drum, are preliminarily removed by the rotatable fur brush at the upstream portion of the contacting zone. The toner particles accumulated on the top surface of the cleaning edge, and other particles of larger size escaping from the rotatable cleaning brush and being mixed with the toner particles, are scraped off the surface of the drum by the edge of the blade. Almost all of the contaminants brushed by the brush and scraped by the cleaning edge from the surface of the drum, are removed efficiently by the aid of air flow caused by the suction means, and collected in a toner collecting means. A cleaning housing of the suction means encloses the brush and the blade except for an opening through which the blade and the fur brush contact the surface of the recording medium in order to guide the suctioned air to form an effective air flow having a speed sufficient to remove the scraped and brushed contaminants and transfer them to the collecting means. To enhance the air speed of the air flow, an air intake passage is formed within the rotatable brush.

These, together with the other objects and advantages, which will be subsequently apparent, reside in the details of construction and operation as more fully hereinafter described and claimed, reference being made to the accompanying drawings formed a part hereof, wherein like numerals refer to like parts throughout.

DESCRIPTION OF THE PREFERRED EMBODIMENT

Figure 1:
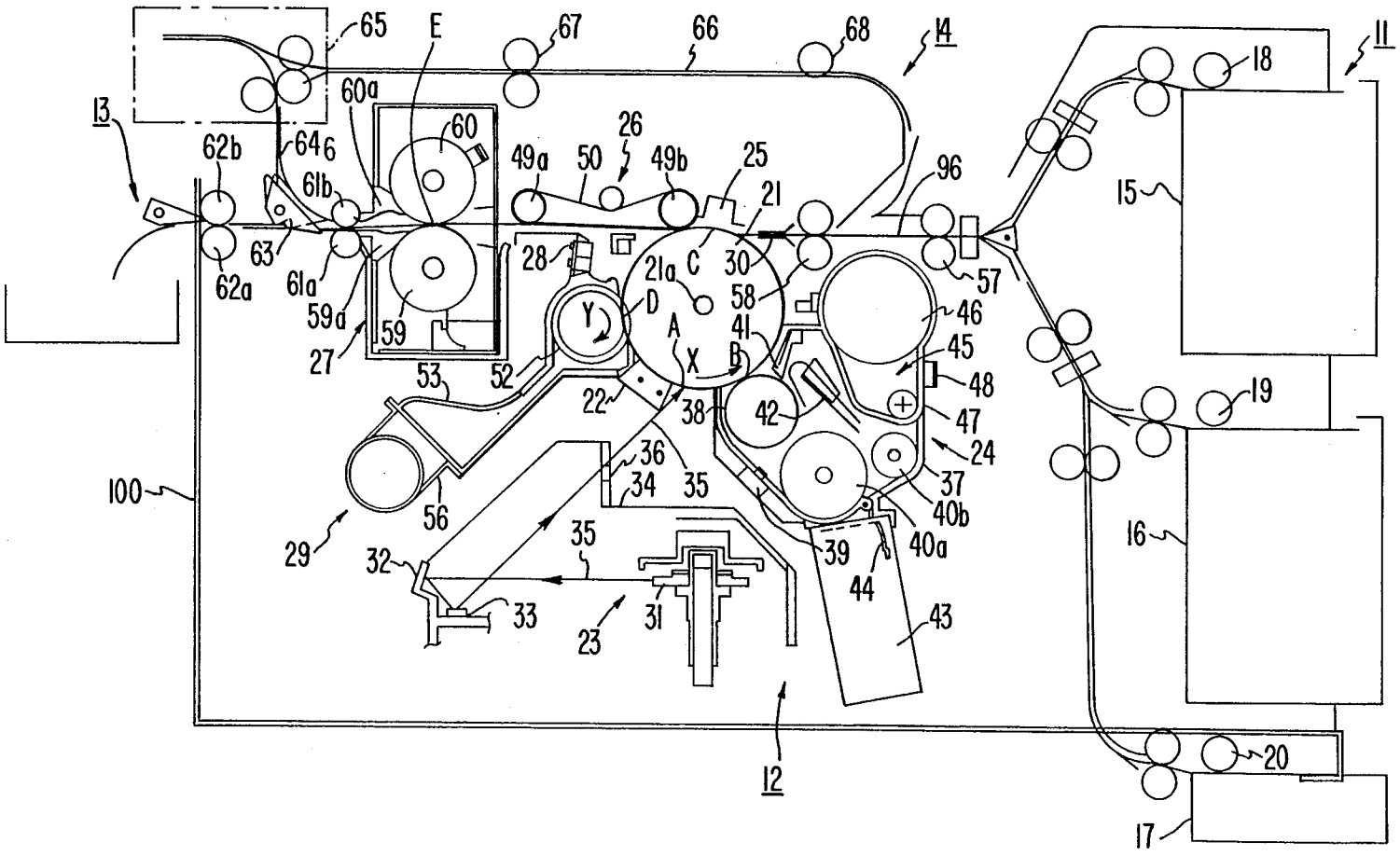
FIG. 1 is a cross-sectional side view of an electrophotographic recording apparatus according to the present invention.

FIG. 1 is a cross-sectional side view of an electrophotographic recording apparatus, illustrating the structural configuration. The apparatus is comprised of a sheet feed unit 11, an electrophotographic processing section 12, a sheet stacker unit 13, and a sheet reversing unit 14. These apparatus elements are enclosed and mounted within a housing 100. The housing 100 includes various frame structures for supporting the elements of the apparatus and housing plates.

The sheet feed unit 11 comprises two conventional sheet hoppers 15 and 16, and a sheet cassette 17. A number of cut sheets having the same sheet size and the same sheet quality are stacked in alignment in one of the hoppers 15 and 16, and the sheet cassette 17. Pick rollers 18, 19 and 20 are disposed corresponding to the sheet hopper 15 and 16, and the cassette 17, to separate a sheet from the stack of sheets one by one and selectively transfer the sheet to the electrophotographic processing section 12. With the above-described configuration, the apparatus can hold sheets of three types at the same time.

The electrophotographic processing section 12 comprises a photoconductive drum 21, a precharger 22, an optical exposer 23 for forming a latent image on the surface of the photoconductive drum 21, a developer 24, an image transfer means 25, a sheet transfer means 26, an image fixer 27, a discharger 28, and a cleaning unit 29. The above-described elements of the apparatus, except for the cleaning unit 29, are conventional elements widely used in the field.

The photoconductive drum 21 includes an organic photoconductive layer or an amorphous silicon photosensitive layer, and is rotatable clockwise, as shown by an arrow X, around a shaft 21*a* which is horizontally supported at both ends by supporting members (not shown) fixed to the apparatus housing 100. A sheet guide 30 is disposed in the vicinity of the upper portion of the photoconductive drum 21 and fixed to the housing 100 to introduce a cut sheet delivered from one of the sheet hoppers 15, 16 or the sheet cassette 17.

The image transfer means 25 is mounted so as to face the top portion of the photoconductive drum 21. The cut sheet is fed along a sheet feed passage 96 by the aid of feed roller pairs 57 and 58 and introduced between the photoconductive drum 21 and the image transfer means 25 through the sheet guide 30. Thus an image transfer station C is formed at the top portion of the photoconductive drum 21 as indicated in FIG. 1, and the sheet is transferred substantially horizontally. A part of the apparatus housing 100 is openable from the upper side thereof, facilitating the removal of the photoconductive drum 21 for replacement with a new drum and removal of sheet jamming which tends to occur in the vicinity of the sheet guide 30. This is an important advantage of the structural configuration shown in FIG. 1.

The optical exposer 23 comprises a rotating mirror 31, reflecting mirrors 32 and 33, a cover housing 34 strengthened by a frame (not shown) to which the above-described elements are secured. The rotating mirror 31 is rotated at a high speed by a drive motor (not shown) and deflects a laser beam 35 injected thereto. The laser beam 35 is projected on the surface of the photoconductive drum 21 at an exposing station indicated by the letter A through the use of the mirrors 32 and 33, and an f-Θ lens (not shown), forming an electrostatic latent image on the photoconductive drum 21. The cover housing 34 encloses the elements of the optical exposer 23 to shield the elements from toner particles scattering inside the apparatus housing 100. The cover housing 34 has a glass window 36 to allow the passage of the laser beam 35 to the photoconductive drum 21.

The developer 24 comprises a toner reservoir 37 to hold a two-component developing material containing toner particles and toner carries, developer roller 38 to form a magnetic brush thereon, a toner density sensor 39 for sensing the density of the toner particles contained in the two-component developing material, stirring rollers 40*a* and 40*b* to stir the developing material held in the toner reservoir 37, a doctor blade 41 to control the height of the magnetic brush formed on the developer roller 38, a flow restricter 42 to control the flow of the developing material in the toner reservoir 37, and a toner recovery box 43 to collect and deposit used toner particles. A hinged releasing door 44 is provided in the bottom portion of the toner reservoir 37 to release the used toner particles deposited in the bottom of the toner reservoir 37 into the toner recovery box 43. A toner supply hopper 45 comprising a toner cartridge receiver 46 and a supply roller 47 is disposed adjacent to the toner reservoir 37 forming a single body with the toner reservoir. The toner particles supplied from the toner cartridge in the toner Cartridge receiver 46, are transferred to the toner hopper 45 by the supply roller 47. The developer roller 38 is comprised of a magnetic roller and an outer sleeve of non-magnetic material rotatable with the magnetic roller. A sheet transfer means 26 includes a belt 50 extended between belt rollers 49*a* and 49*b*. An electric charger (not shown) for electrically charging the belt 50 is attached thereto.

Figure 2:
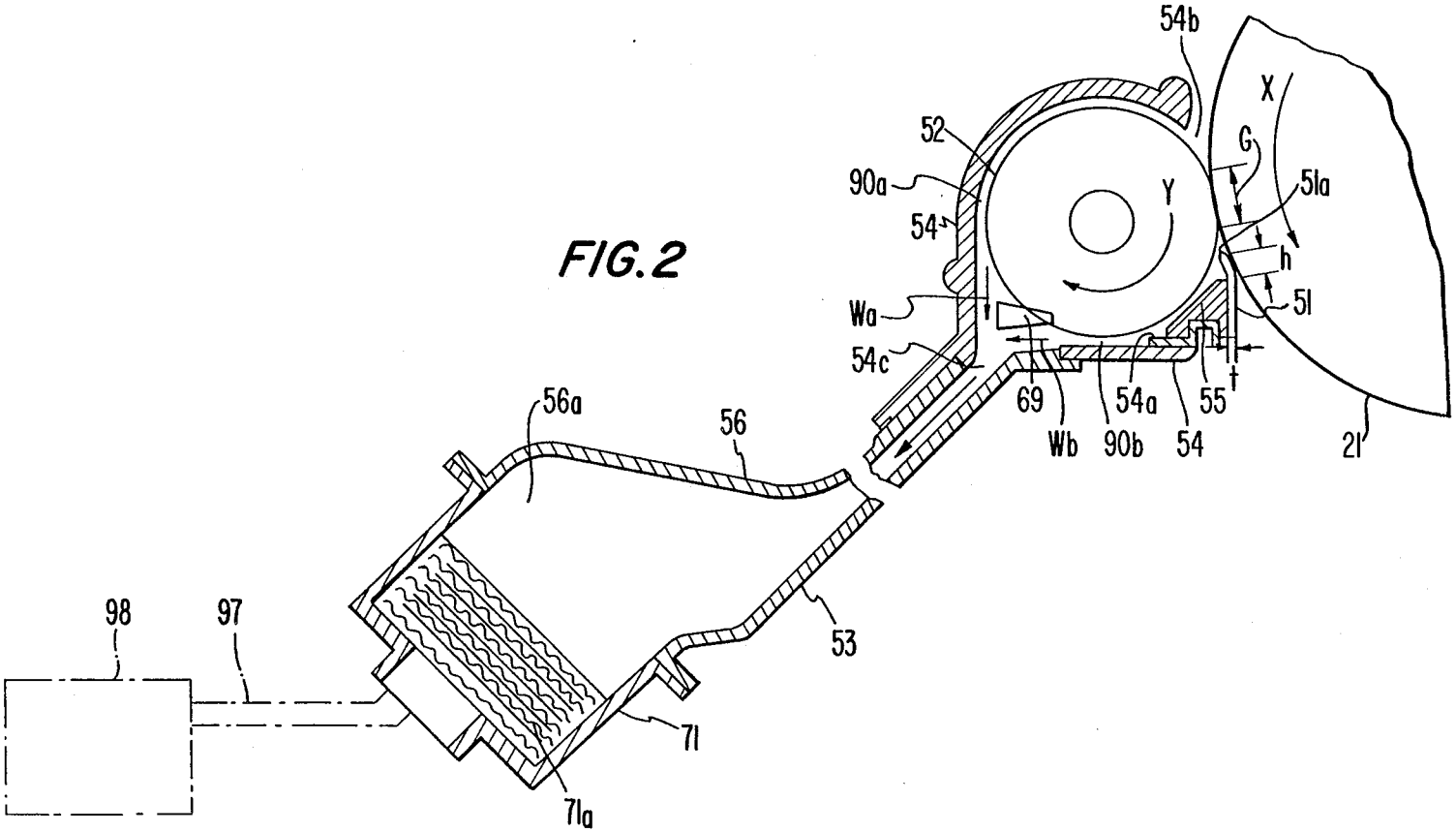
FIG. 2 is an enlarged cross-sectional view of the cleaning unit of the present invention illustrating the structure in more detail.
Figure 3:
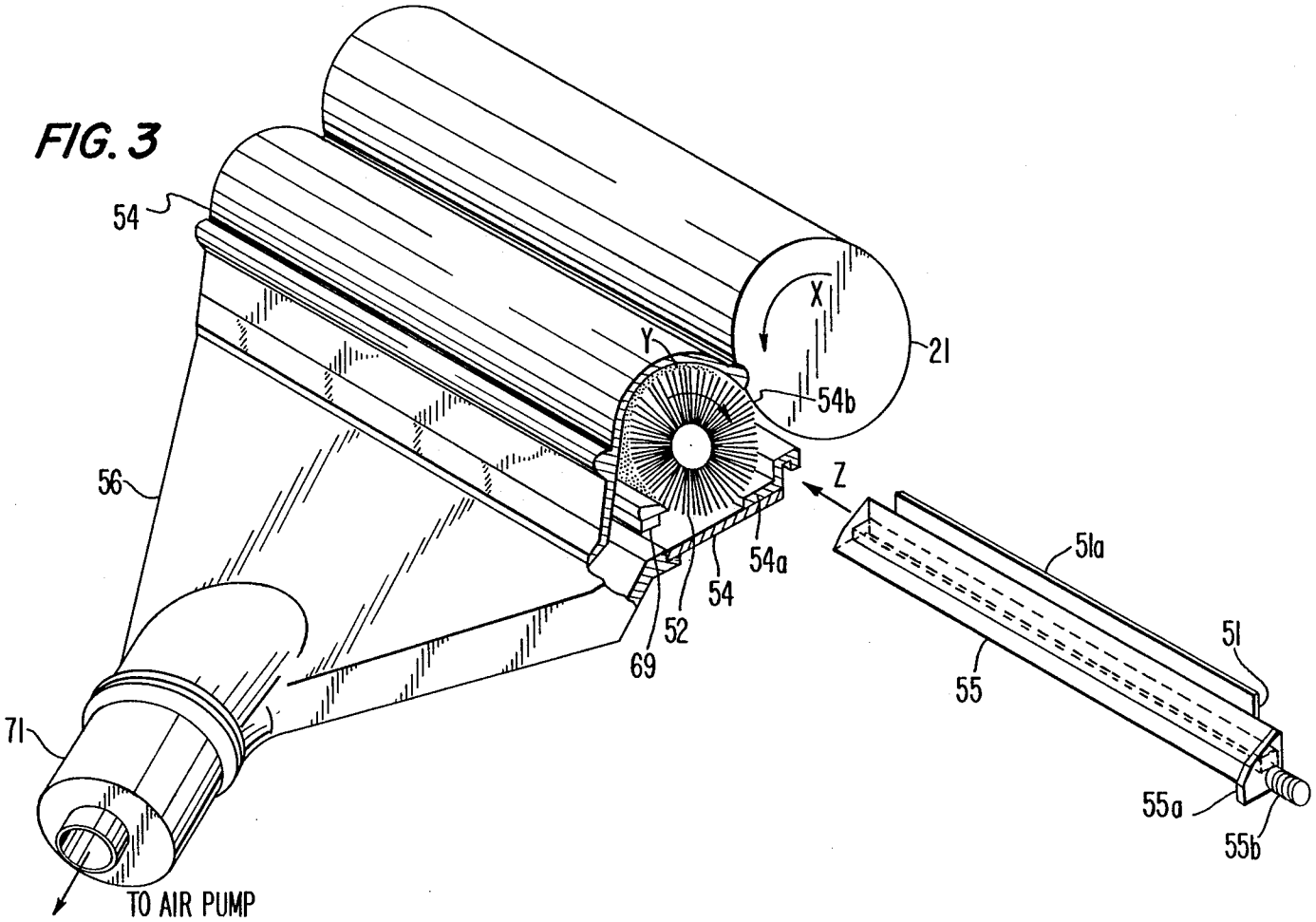
FIG. 3 is a perspective view of the cleaning unit of the present invention.

FIG. 2 and FIG. 3 are, respectively, a cross-sectional view and a partially broken perspective view of the cleaning unit 29, illustrating the structure thereof in greater detail. The cleaning unit 29 comprises a blade 51, a rotatable cleaning means 52, a suction means 53 and a cleaning housing 54.

Figure 4:
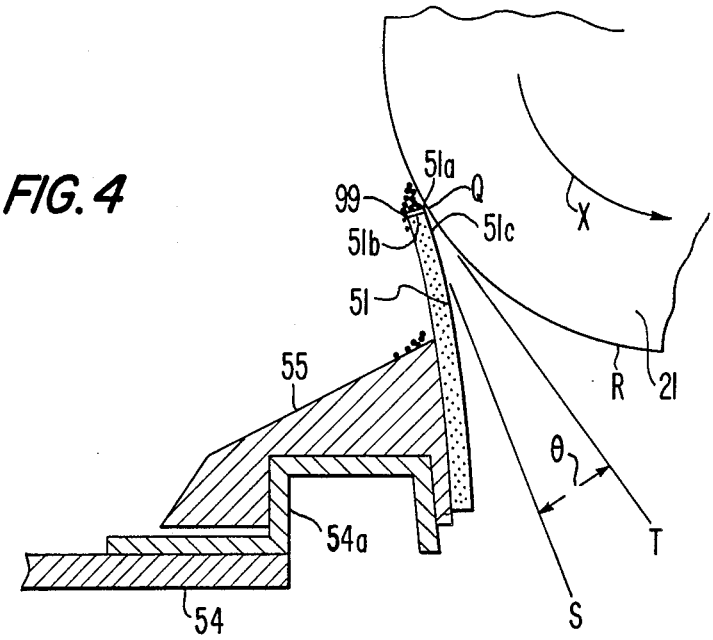
FIG. 4 is a schematic cross-sectional view of the blade and the associated members, illustrating the angle of the blade with respect to the surface of the photoconductive drum.

The blade 51 is detachably mounted on a bottom member 54*a* which is connected in air tight fashion to the bottom portion of the cleaning housing 54 through a supporting member 55. FIG. 4 is an enlarged schematic cross-sectional view of the blade 51 and the associated members, cut in a plane perpendicular to the longitudinal direction, illustrating the positional relationships. The blade 51 extends in a direction parallel with the axis of the photoconductive drum 21 such that the edge 51*a* of the blade contacts the surface of the photoconductive drum 21 (hereinafter the edge 51*a* is referred to as a cleaning edge) so as to scrape the surface along the entire axial length of the drum. The blade 51 has an extended rectangular cross-section having a top surface 51*b* substantially perpendicular to the side surface 51*a*. The blade 51 is made of polyurethane rubber (product of Bandou Kogaku Co.) having a Young's module of 45 Kg/square centimeter, a hardness of HS 60 degree (defined in Japanese Industrial Standards), a thickness of 1.5 mm (indicated by t) and a height of the cantilever portion of the blade of 6 mm indicated by h in FIG. 2). The straightness of the cleaning edge 51*a* lies within 10 microns, and the corner round is limited below 10 microns.

The blade 51 is secured to the supporting member 55 with thermoplastic adhesive material. The cross-section of the supporting member 55 perpendicular to the longitudinal direction has the shape of an inverted U, and engages with the bottom member 54*a* which has a cross-section of the same shape as that of the supporting member 55 such that the supporting member 55 is received by the bottom member 54 slidably in the longitudinal direction over the bottom member 54*a* as shown by an arrow Z in FIG. 3. Consequently, the bottom member 54*a* is a rail member. Both members 54*a* and 55 are fixed to each other by the use of clamping structure (not shown) when the blade 51 is set at a predetermined position. Since, the cleaning edge 51*a* of the blade 51 may be abraded during long periods of operation, the blade 51 needs to be replaced from time to time. With the above-described sliding structure, mounting and dismounting of the blade 51 is easily carried out. The supporting member 55 extends all along the blade 51, closing the space between the blade 51 and the bottom member 54*a*. Thus, the supporting member 55 is designed to act as part of the shielding means of the cleaning unit 29.

In FIG. 4, the set angle 8 of the blade 51 with respect to the surface of the photoconductive drum 21 is illustrated. The cross-section of the drum 21 is represented by a circle R. The set angle is defined as an angle between a tangential line T of the circle R at a point Q where the cleaning edge 51*a* contacts the drum 21, and a tangential line S of the side surface 51*c* of the blade 51 at the blade edge 51*a*. The set angle is selected to be an acute angle as shown in FIG. 4, and 30 degrees is a desirable angle. A cleaning blade engaged with a rotating drum with an acute set angle like the above-described one is referred to as a blade of counter type.

The rotatable cleaning means 52 is a cylindrical, rotatable fur brush, or a roller having a surface layer made of sponge-like material, such as polyurethane foam, and is disposed in the cleaning housing 54 such that the axis of the rotatable cleaning means 52 is horizontal and in parallel with the axis of the photoconductive drum 21. In the following description, the rotatable cleaning means is referred to as a rotatable fur brush. In practice, the rotatable fur brush 52 has elastic brush hairs or bristles made of rayon fibers 12.5 Denier thick, mounted on a shaft with a density of 2500 bristles per square inch. The rotatable fur brush 52 is disposed such that the tips of the bristles are pressed against the surface of the drum 21 to form a contacting zone G (FIG. 2) on the surface of the drum 21. The zone G has a certain width and extends in the axial direction of the drum 21. The rotatable fur brush 52 is also mounted such that the tips of the brush bristles are free from the edge of the blade 51, to leave a narrow space between the cleaning edge 51*a* and the contacting zone G. Otherwise, the tips of the bristles may be damaged by the blade 51 contacting them.

The cleaning housing 54 encloses the rotatable fur brush 52 closely with a small space therebetween except for an opened portion 54*b* through which the blade 51 and the rotatable fur brush 52 can engage the surface of the photoconductive drum. The bottom portion of the cleaning housing 54 has a connecting opening 54*c* opening downwardly to be connected to a duct 56 of suction means 53. The cleaning housing 54 is fixed to the apparatus housing 100 in a position located at the lower left side of the photoconductive drum 21, as shown in FIG. 1 and FIG. 2. The fixing position of the cleaning housing 54 is carefully selected so that, during a cleaning operation, the upwardly directed cleaning edge 51*a* of the blade 51 contacts a downwardly moving portion of the rotating photoconductive drum 21 with a predetermined pressure, such as 15.8 gr/cm, and the rotatable fur brush 52 is pressed against a portion of the drum immediately upstream from the cleaning edge 51*a* to form the contacting zone G. A flicker blade 69 is mounted to engage the bristles of the rotatable fur brush 52 to remove particles attached thereto.

The suction means 53 includes a duct 56, a toner recovering box 71, an air pipe 97 (shown by dotted lines) and an air suction fan or an air pump 98 (shown by dotted lines). The duct 56 is connected to the cleaning housing 54 through the connecting opening 54*c*, and to the toner recovering box 71 at the bottom portion 56*a* of the duct by a flange coupling. The toner recovering box 71 has a conventional air filter 71*a* similar to a filter used for a vacuum cleaner, to collect the toner particles and other contaminants scraped off the surface of the photoconductive drum 21 by the blade 51 and the rotatable bur brush 52. The air pump 98 is connected to the duct 56 through the air pipe 97 and the toner recovery box 71. The contaminants deposited in the filter 71*a* are removed by decoupling the toner recovery box 71 when necessary.

With the above-described structural configuration of the suction means 53, the space inside the cleaning housing 54 is evacuated to a low pressure of approximately 200 mm Aq. As a result, air is drawn into the cleaning housing 54 through the opening 54*b*. The air flows around the surface of the rotatable fur brush 52, and is discharged through the opening 54*c*. The removal efficiency of toner particles and other contaminants which are scraped by the blade 51 and taken off by the rotatable fur brush, substantially depends on the air flow velocity in the space adjacent to the cleaning edge 51*a* of the blade 51. The cleaning unit 29, except for the opening 54*b*, is enclosed in air-tight fashion so that contaminants, in particular, toner particles, will not be scattered within the apparatus housing 100, causing various problems in the recording apparatus. The enclosing structure serves to create an air flow within the cleaning housing 54 as described latter.

The operation of the above-described electrophotographic recording apparatus is described hereafter. A cut sheet is selectively delivered from one of the sheet hoppers 15, 16 or the sheet cassette 17, and is advanced by the aid of the feed roller pairs 57 and 58 along the sheet feed passage 96. The sheet is then introduced into the electrophotographic processing section 12 through the sheet guide means 30, and reaches the toner image transfer station C. A latent image is formed on the surface of the photoconductive drum 21 which previously has been electrically uniformly charged by the precharger 22 and exposed to the irradiation of the laser beam 35 at the exposing station A. The latent image is moved to the developing station B in contact with the magnetic brush of the developing material formed on the developer roller 38, and is developed to form a toner image on the surface of the photoconductive drum 21. The cut sheet and the toner image formed on the surface of the photoconductive drum 21 are advanced in synchronized movement, and the toner image is transferred adhesively onto the cut sheet at the image transfer station C.

Then, the sheet is attracted electrostatically by the electrically charged belt 50 to be peeled off the photoconductive drum 21, and transferred to the image fixed station E. The sheet is pinched by a heat roller 59 and a press roller 60 of the image fixer 27, whereby the toner image is heated and pressed against the sheet and permanently fixed on the surface of the sheet. Thereafter, the sheet is separated off the rollers 59 and 60 by roller separators 59*a* and 60*a*, advanced by feed roller pairs 61*a*, 61*b* and 62*a*, 62*b* to the sheet stacker unit 13 and is discharged therein.

When printing on both sides of the sheet is required, the leading edge of the sheet delivered from the feed rollers 61*a*, 61*b* is picked up by a switching member 63 to change the feed direction upwardly, and the sheet is transferred into the sheet reversing unit 14 through a guide member 64. The sheet is reversed by a conventional reversing mechanism 65 (simply represented by dotted lines) and fed back through a guide passage 66 to the image transfer station C again by the aid of feed roller pairs 67 and 68.

The portion of the surface of the photoconductive drum 21 from where the toner image is removed by the image transfer is discharged by the discharger 28 and moved to the cleaning station D to clean the portion.

The portion of the surface of the photoconductive drum 21 to be cleaned comes first in contact with the rotatable fur brush 52.

The rotatable fur brush 52 is rotated in a clockwise direction as indicated by an arrow Y. Since the surface of the photoconductive drum 21 rotates in anti-clockwise direction, the fur brush 52 and the drum 21 move in the same direction, namely, in a downwardly moving direction, at the contacting zone G. The surface velocity of the rotatable fur brush 52 is from two to three times that of the photoconductive drum 21. Consequently, the rotatable fur brush 52 rubs the surface of the photoconductive drum 21 with a speed of from one to two times the surface speed of the photoconductive drum 21.

The residual contaminants having a relatively larger size than that of the toner particles such as toner carriers and paper lints are removed by the rotatable fur brush 52 at the upstream portion of the contacting zone G. The contaminants of a smaller size, mainly toner particles, and some of contaminants of larger size, however, may escape from the cleaning brush 52. These escaped contaminants are scraped by the cleaning edge 51*a* of the blade 51 which is in pressure contact with the surface of the photoconductive drum 21. The fine toner particles and some of toner carriers and paper lints are accumulated on the cleaning edge 51*a* and along the surface of the photoconductive drum 21 adjacent to the cleaning edge 51*a*, forming a pile 99 of contaminants (see FIG. 4). The upper part of the pile 99 is taken off by the rotatable cleaning brush 52 at the downstream portion of the contacting zone G. As the result, the cleaning edge 51*a* is free from undesirable contaminants of larger size such as toner carrier particles and paper lints, thus extending the life of the blade 52. This is one of the advantageous features of the cleaning unit 29 according to the present invention.

The reason that cleaning brush 52 engages with the surface of the drum 21 in the same downward direction is that if the fur brush 52 is rotated in the opposite direction, namely clockwise, the surface of the fur brush, will move upwardly at the contacting zone G. By this movement of the brush bristle tips, the residual contaminants on the surface of the photoconductive drum can be removed. However, the removed contaminants would be ejected upwardly and outside the cleaning housing 54 from the opening 54*b*, scattering inside the recording apparatus and causing various problem. Thus, an upwardly moving surface of bristle tips would not be suitable for removing the residual contaminants scraped by the blade 51.

The contaminants of large size which are brushed away by the rotatable fur brush 52 and the contaminants of small size which are scraped by the blade 51, are carried by the flow of suction air which is generated by air suctioned into the cleaning housing 54 through the opening 54*b* of the cleaning housing 54. The contaminants carried by the air flow are transferred and introduced into the toner recovering box 71 through the duct 56. The cleaned portion of the photoconductive drum 21 is then moved to the optical exposing station A for subsequent forming of another latent image.

Since the structure and the function of the cleaning unit 29 is a primary feature of the present invention, a more detailed description of this feature and advantages thereof are set forth hereafter. In the cleaning unit 29, the blade 51, the rotatable fur brush 52 and the suction means 53 work in cooperation with the aid of the cleaning housing 54.

First, the rotatable fur brush 52 preliminary removes the toner carriers and paper lints of larger size before the cleaning edge 51*a* starts to scrape contaminants from the surface of the photoconductive drum 21. As a result, the probability of contacts between containment particles of larger size and the cleaning edge 51*a* is substantially reduced. Abrasion of the cleaning edge 51*a* is caused mainly by the contaminants of large size in contact with the cleaning edge 51*a*. Therefore, direct contact of the contaminants of larger size with the cleaning edge 51*a* should be substantially avoided. In this way, the life of the blade 51 is prolonged over that which would occur in the absence of the brush.

Second, the rotatable fur brush 52 takes off the upper part of the pile 99 of the contaminants accumulated on the cleaning blade and in the vicinity thereof. The major part of the pile 99 is composed of fine toner particles, since such fine particles can pass through the brush bristles, and minor part of the pile 99 is composed of larger particles such as toner carriers and paper lints which tends to be concentrated at the upper portion of the pile 99 due to the associated small vibration of the relevant elements of the apparatus. Accordingly, the large sized particles which escape from the brush bristles are captured again by the brush hairs at the top of the pile 99 and are removed.

Meanwhile, the toner particles act as a lubricant to reduce the friction between the blade 51 and the surface of the photoconductive drum 21, suppressing scratching of the surface of the surface caused by the blade 51. By taking the pile 99 off at the downstream portion of the contacting zone G, the life of the blade 51 is prolonged and the inside of the apparatus is prevented from being contaminated.

Third, as described before, the air-tight enclosing structure of the cleaning unit 29, except for the opening 54*b*, serves to create air flow caused by suction. As shown in FIG. 2, a narrow space 90*a* is formed between the cleaning housing 54 and the fur brush 52 along the upper portion of the surface of the fur brush 52, allowing air flow Wa to pass. Another narrow space 90*b* is formed along the lower portion of the fur brush 52, allowing air flow Wb to pass. The space 90*b* is surrounded by the photoconductive drum 21, the blade 51 and the bristles of the rotatable cleaning brush 52, and external air is sucked through the small clearances between the bristles of the brush. The air flow Wb acts to remove contaminants scraped by the blade 51 and prevents the contaminants from attaching to the surface adjacent to the cleaning edge 51*a*. The air flow Wa acts to remove the contaminants attached to the fur brush bristles.

The velocity of the air flow Wb is much lower than that of the air flow Wa, since pneumatic resistance to the air flow Wb is high because the air flow Wb must pass through the bristles of the fur brush 52, while the air flow Wa may run through the space 90*a* without any significant pneumatic resistance. In order to enhance the velocity of the air flow Wb, an improved rotatable cleaning brush having an air flow passage through which external air is introduced may be employed.

Figure 5:
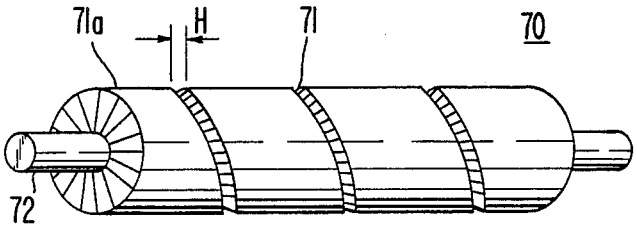
FIG. 5 is a perspective view of an improved rotatable cleaning fur brush of the present invention.

FIG. 5 is a perspective view of an improved fur brush 70, having a single spiral groove-like space 71 which is formed by the selective absence of the brush bristles 71*a* mounted on a rotatable solid shaft 72. External air is able to be sucked in and flow through the spiral space 71 during the rotation of the fur brush 70. A preferred width H of the space or groove 71 is 2 millimeters and the spiral pitch is 50 millimeters and the length thereof is 340 millimeters. Although, the spiral shown in FIG. 5 is a single spiral, a multiple spiral such as double spiral may also be used.

Figure 6A:
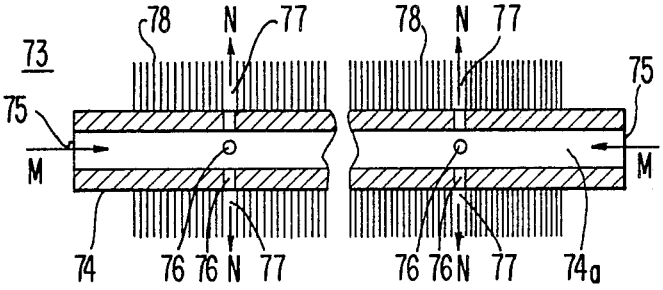
FIG. 6(*a*) and FIG. 6(*b*) are, respectively, a cross-sectional front view and a side view of the rotating cleaning fur brush.
Figure 6B:
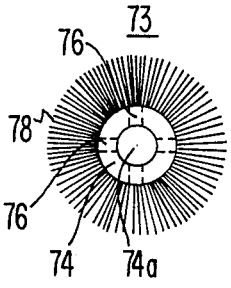

FIG. 6(*a*) and FIG. 6(*b*) are, respectively, front and side cross-sectional views of another improved fur brush 73 having a hollow cylindrical shaft 74 with an inner space 74*a*. The shaft 74 has an opening 75 at each end to suck in external air. The hollow shaft 74 has a plurality of spaced, small holes 76 in the cylindrical side-wall distributed in the axial direction of the shaft 74. The small holes 76 are opened radially, and the angular positions with respect to the axis of the holes 76 are spaced by several phase angles such as four radial directions mutually spaced by 90 degrees as shown in FIG. 6(*b*). The bristles 78 do not cover the holes 76, thereby forming cylindrical spaces 77. The air sucked in through the openings 75, as indicated by arrows M, flows through the inner space 74*a* of the shaft, and radially outwardly, as indicated by arrows N, through the spaces 77 when the spaces 77 is opened toward the space 90*b*. Other modified air flow passages formed in the fur brush may also be employed.

Employing an electrophotographic recording apparatus having the above-described structural configuration and including a rotatable cleaning brush 70 as shown in FIG. 5, a repeated printing operation test was conducted for a substantial time in order to confirm the effect of the invention. The surface velocity of the photoconductive drum 21 was 265 mm/sec, and that of the fur brush 52 was selected from 530 to 790 mm/sec. The test showed that, the abrasion life of the blade 51 was extended from an average of 75,000 sheets of A4 size (210 mm×297 mm) for a prior art apparatus to approximately 250,000 sheets of the same size, over a three-fold increase.

Figure 7A:
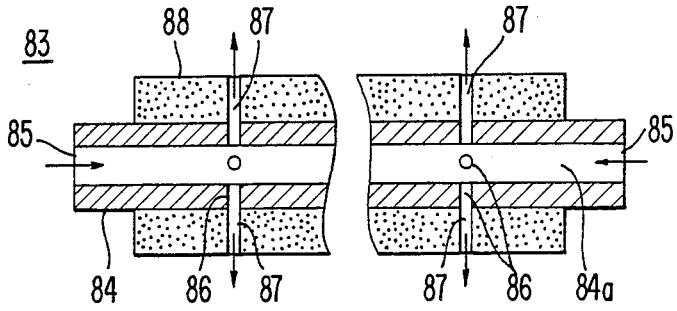
FIG. 7(*a*) and FIG. 7(*b*) are, respectively, a cross-sectional front view and a side view of a rotatable cleaning cylinder made of sponge like material and having a hollow shaft.
Figure 7B:
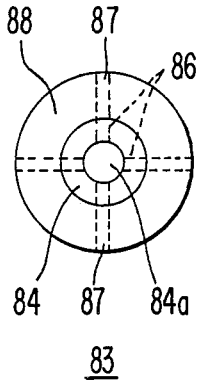

FIG. 7(*a*) and FIG. 7(*b*) are, respectively, front and side cross-sectional view of another embodiment of rotatable cleaning cylinders 83. Shown in these figures is a hollow cylinder shaft 84 having an inner space 84*a*. The above-described cleaning brushes shown in FIG. 5 or FIG. 6 may be replaced by the rotatable cleaning cylinder 83 which has a cleaning layer 88 of sponge-like material such as plastic foam formed around the shaft 84 so as to have a cylindrical surface. The shaft 84 has an opening 85 at each end to suck in external air. The hollow shaft 84 has a plurality of small holes 86 in the cylindrical side-wall, distributing in the axial direction of the shaft 84. The small holes 86 open radially, and the angular positions with respect to the axis of the holes 86 are distanced by several phase angles such as four radial directions mutually spaced by 90 degrees. The cleaning layer 88 is not on the holes 86, resulting in cylindrical spaces 87. The air sucked in through the openings 85, as indicated by the arrows M, flows through the inner space 84*a* of the shaft, and radially outwardly, as indicated by arrows N, through the spaces 87 when the spaces 87 are opened toward the space 90*b*. Other types of air flow passages may also be formed in the cleaning cylinder or brush.

Figure 8:
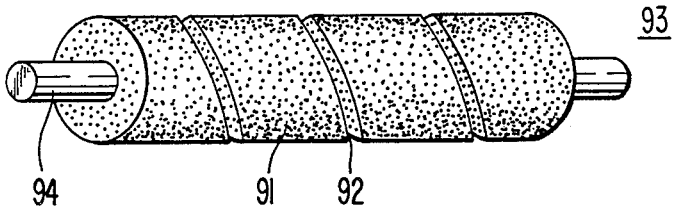
FIG. 8 is a perspective view of a rotatable cleaning cylinder having a cylindrical layer made of sponge-like material.

FIG. 8 is a perspective view of a cleaning cylinder 93 corresponding to the cleaning brush shown in FIG. 5 in which a groove-like spiral air passage 92 is formed in a rotatable cleaning layer 91 made of sponge-like polymer material, formed around a solid shaft 94. External air can be sucked inside the cleaning housing 54 in the same manner as the cleaning brush 70 of FIG. 5.

An additional advantage of the present invention resides in the simple structure for holding the blade. With the present invention, the blade 51 always engages the surface of the photoconductive drum 21 regardless of the operational steps of the recording apparatus. In many of the prior art recording apparatus, a blade engages the surface of the drum only during a cleaning operation and is disengaged during other operations of the apparatus, in order to protect the blade and the surface of the drum. This results in a more complicated structure to support the blade and increases the cost of the recording apparatus.

Numerous alterations and modifications of the structure herein disclosed will suggest themselves to those skilled in the art. It is to be understood, however, that the present disclosure relates to the preferred embodiments of the invention which is for purposes of illustration only and is not to be construed as a limitation of the invention. All such modifications which do not depart from the spirit of the invention are intended to be included within the scope of the appended claims.

What I claim is:

1. An image transfer type recording apparatus comprising:

a drum rotatable around a substantially horizontal axis;

a recording medium layer formed on said drum for forming a toner image on the surface of said recording medium layer;

a toner image transfer means disposed adjacent to the top portion of said drum for transferring said toner image to a printing medium; and a cleaning unit disposed downstream from said toner image transfer means with respect to the rotation of said drum, for cleaning the surface of said recording medium layer after image transfer, said cleaning unit comprising:

a blade extending across said drum and having a cleaning edge in contact with said recording medium layer for scraping said layer to remove contaminants thereon as said drum rotates;

rotatable cleaning means extending across said drum, disposed upstream from said blade in engagement with said recording medium layer for removing contaminants thereon as said drum rotates;

a housing enclosing said blade and said rotatable cleaning means and having an opening for the entry of external air and an outlet for the exit of air; and suction means connected to said outlet for excavating the space inside said housing;

said rotatable cleaning means having an air passage for passing external air into a space in said housing which is surrounded by surfaces of said rotatable cleaning means, said blade, and said drum, and connected to said suction means, whereby the velocity of the air flow in said space is enhanced to facilitate removal of said contaminants from the surface of said drum.

2. The image transfer type recording apparatus of claim 1, wherein said drum and said rotatable cleaning means are rotated in opposite directions to each other, and the circumferential velocity of said rotatable cleaning means is higher than that of said drum.

3. The image transfer type recording apparatus of claim 1, wherein said rotatable cleaning means is a rotatable brush mounted on a shaft.

4. The image transfer type recording apparatus of claim 3, wherein said rotatable brush comprises bristles mounted on said shaft, and said air passage is a groove-like space formed among said bristles, said space being extended along said shaft in a spiral.

5. The image transfer type recording apparatus of claim 3, wherein said shaft is a hollow cylindrical shaft which has an opening in at least one end thereof for the entry of external air and a perforated cylindrical wall for the exit of said air.

6. The image transfer type recording apparatus of claim 1, wherein said rotatable cleaning means is a rotatable cylinder comprising a shaft having a layer of sponge-like material thereon to form a cylindrical surface.

7. The image transfer type recording apparatus of claim 6, wherein said air passage is a groove-like space in said layer of sponge-like material, said space extending along said shaft in a spiral.

8. The image transfer type recording apparatus of claim 6, wherein said shaft is a hollow cylindrical shaft having at least one end open for the entry of external air and a plurality of holes in the wall thereof, said layer of sponge-like material also having holes therein corresponding to the holes in said shaft wall for the exit of said air.

9. The image transfer type recording apparatus of claim 1, wherein said cleaning unit further comprises a rail member extending parallel to said drum, and said blade is supported by a supporting member having a groove therein of the same configuration as said rail member whereby said blade is mountable and dismountable by sliding movement along said rail member by said supporting member.

10. An electrophotographic recording apparatus comprising:

a photoconductive drum rotatable around a substantially horizontal axis for forming a toner image on the cylindrical surface thereof;

a toner image transfer means disposed adjacent to the top portion of said photoconductive drum for transferring said toner image to a printing medium; and a cleaning unit disposed downstream from said toner image transfer means with respect to the rotation of said photoconductive drum, for cleaning said cylindrical surface of said photoconductive drum after image transfer, said cleaning unit comprising:

a blade extending across said drum and having a cleaning edge in contact with said cylindrical surface for scraping said cylindrical surface to remove contaminants thereon as said drum rotates;

rotatable cleaning means extending across said drum, disposed upstream from said blade in engagement with said cylindrical surface for removing contaminants thereon as said drum rotates;

a housing enclosing said blade and said rotatable cleaning means and having an opening for the entry of external air and an outlet for the exit of air; and suction means connected to said outlet for excavating the space inside said housing;

said rotatable cleaning means having an air passage capable of passing external air into a space in said housing which is surrounded by surfaces of said rotatable cleaning means, said blade, and said drum, and connected to said suction means, whereby the velocity of the air flow in said space is enhanced to facilitate removal of said contaminants from the surface of said drum.

11. An image transfer type recording apparatus comprising:

a drum rotatable around a substantially horizontal axis;

a recording medium layer formed on said drum for forming a toner image on the surface of said recording medium layer;

a toner image transfer means disposed adjacent to the top portion of said drum for transferring said toner image to a printing medium; and a cleaning unit disposed downstream from said toner image transfer means with respect to the rotation of said drum, for cleaning the surface of said recording medium layer after image transfer, said cleaning unit comprising:

a blade extending across said drum and having an upwardly directed cleaning edge in contact with a downwardly moving portion of the surface of said recording medium layer for scraping the surface of said layer to remove contaminants thereon with said cleaning edge as said drum rotates;

rotatable cleaning means extending across said drum, disposed immediately upstream from said blade without contacting said blade and in engagement with said recording medium layer for removing contaminants remaining on the surface of said recording medium layer adjacent to said cleaning edge and accumulated on said cleaning edge as said drum rotates;

a housing enclosing said blade and said rotatable cleaning means and having an opening for the entry of external air and outlet for the exit of air; and suction means connected to said outlet for excavating the space inside said housing means;

said rotatable means having an air passage for passing external air into a space in said housing which is surrounded by surfaces of said rotatable cleaning means, said blade, and said drum, and connected to said suction means, whereby the velocity of the air flow in said space is enhanced to facilitate removal of said contaminants from the surface of said drum.

* * * * *

UNITED STATES PATENT AND TRADEMARK OFFICE

CERTIFICATE OF CORRECTION

PATENT NO. : 4,984,028

DATED : January 8, 1991

INVENTOR(S) : YOSHIHIRO TONOMOTO

It is certified that error appears in the above-identified patent and that said Letters Patent is hereby corrected as shown below:

FRONT PAGE Insert

--FOREIGN PATENT DOCUMENTS

| | | |
|---|---|---|
| 0103405 | 3/21/84 | Europe |
| 3026025 | 1/22/81 | Germany |

OTHER DOCUMENTS

Xerox Disclosure Journal Vol. 2, No. 5, September/October 1977, pages 105, 106; K. Ayash et al.: "Brush cleaner with pressurization and charge neutralization".

Xerox Disclosure Journal, Vo. 4, No. 4, July/August 1979, page 531; A. T. Manghirmalani et al.: "Foam air cleaner".--

UNITED STATES PATENT AND TRADEMARK OFFICE

CERTIFICATE OF CORRECTION

PATENT NO. : 4,984,028

DATED : January 8, 1991

INVENTOR(S) : YOSHIHIRO TONOMOTO

It is certified that error appears in the above-identified patent and that said Letters Patent is hereby corrected as shown below:

Column 1, line 20, delete "or an electro-";
line 21, delete "graphic printing machine or copying machine,".

Column 6, line 7, "Cartridge" should be --cartridge--.

Column 7, line 1, "8" should be --θ--.

Signed and Sealed this

Fourth Day of August, 1992

*Attest:*

DOUGLAS B. COMER

*Attesting Officer*

*Acting Commissioner of Patents and Trademarks*